US005974683A

United States Patent [19]

Shibata

[11] Patent Number: 5,974,683

[45] Date of Patent: Nov. 2, 1999

[54] SHEET INSPECTION APPARATUS FOR SHEET-FED OFFSET PRINTING PRESS

[75] Inventor: Satoshi Shibata, Ibaragi, Japan

[73] Assignee: Komori Corporation, Tokyo, Japan

[21] Appl. No.: 08/899,744

[22] Filed: Jul. 24, 1997

[30] Foreign Application Priority Data

Jul. 25, 1996 [JP] Japan ..... 8-196083

[51] Int. Cl.[6] ..... F26B 19/00

[52] U.S. Cl. ..... 34/88; 34/611; 101/246; 101/409; 271/197; 271/204

[58] Field of Search ..... 34/611, 88; 101/246, 101/232, 409, 420; 271/85, 197, 204

[56] References Cited

U.S. PATENT DOCUMENTS 5,329,852 7/1994 Bolza-Schuenemann et al. ..... 101/232

FOREIGN PATENT DOCUMENTS 0 527 453 8/1992 European Pat. Off. ..... B41F 33/00

0 641 653 8/1994 European Pat. Off. ..... B41F 23/04

63-64748 3/1988 Japan .

6-144682 5/1994 Japan .

*Primary Examiner*—Henry Bennett

*Assistant Examiner*—Pamela A. Wilson

*Attorney, Agent, or Firm*—Blakely Sokoloff Taylor & Zafman

[57] ABSTRACT

A sheet inspection apparatus for a sheet-fed offset printing press includes an endless conveying unit, a plurality of gripper units, and an inspection unit. The conveying unit has a conveying path and a return path and conveys a sheet delivered from a printing unit. The gripper units are supported by the conveying unit at a predetermined interval along a sheet conveying direction to grip one end of the sheet. The inspection unit is arranged on an opposite side of the conveying path with respect to the return path to optically inspect a printed state of the sheet conveyed on the conveying path. The inspection unit is arranged at a position where an optical inspection operation for the sheet at an inspection position on the conveying path is not impeded by the gripper units traveling on the return path.

11 Claims, 4 Drawing Sheets

SHEET INSPECTION APPARATUS FOR SHEET-FED OFFSET PRINTING PRESS

BACKGROUND OF THE INVENTION

The present invention relates to a sheet inspection apparatus for a sheet-fed offset printing press, which detects a misfed sheet in a defective printed state after printing of sheets.

Generally, in a sheet-fed offset printing press of this type, to inspect the printed state of a sheet upon completion of all printing processes, the inspection process is provided after the operation of the impression cylinder of the final printing unit. In this case, when the printed state is to be inspected on the impression cylinder of the final printing unit, the trailing edge of the sheet which has passed between the impression cylinder and a blanket cylinder is pulled to the blanket cylinder side due to the viscosity of the ink on the blanket cylinder, and the sheet largely swings, resulting in so-called instability of sheets. For this reason, determination of properly conveyed sheets and misfed sheets cannot always be exactly performed.

Therefore, as disclosed in Japanese Patent Laid-Open No. 63-64748, a frame is added in a delivery unit continuing to the printing unit. A support plate functioning as a printing paper stabilization means for straining a sheet conveyed by an ejector chain is arranged in this frame in correspondence with the inspection unit such that the sheet is inspected in the sheet conveying unit of the delivery unit.

However, since the inspection unit is set between the impression cylinder of the final printing unit and the delivery unit, an inspection unit adjustment operation or maintenance operation for cleaning paper dust adhering to the detection unit of the inspection unit or anti-setoff powder can hardly be performed, and the maintenance operation takes a long time. Additionally, the sheet conveying unit of the delivery unit has a dryer unit for drying a printed sheet. When the inspection unit is set to be close to this dryer unit, an electronic circuit including electronic components constituting the inspection unit is adversely affected by heat generated by the dryer unit. As a result, the inspection unit erroneously operates to impede to properly inspect the printed state.

SUMMARY OF THE INVENTION

It is an object of the present invention to provide a sheet inspection apparatus for a sheet-fed offset printing press, which can easily perform an adjustment operation and a maintenance operation.

It is another object of the present invention to provide a sheet inspection apparatus for a sheet-fed offset printing press, which highly accurately inspects the printed state of a sheet.

In order to achieve the above object, according to the present invention, there is provided a sheet inspection apparatus for a sheet-fed offset printing press, comprising endless conveying means for conveying a sheet delivered from a printing unit, the endless conveying means having a conveying path and a return path, a plurality of gripper units, supported by the conveying means at a predetermined interval along a sheet conveying direction, for gripping one end of the sheet, and an inspection unit arranged on an opposite side of the conveying path with respect to the return path to optically inspect a printed state of the sheet conveyed on the conveying path, the inspection unit being arranged at a position where an optical inspection operation for the sheet at an inspection position on the conveying path is not impeded by the gripper units traveling on the return path.

DESCRIPTION OF THE PREFERRED EMBODIMENT

An embodiment of the present invention will be described below in detail with reference to the accompanying drawings.

Figure 3:
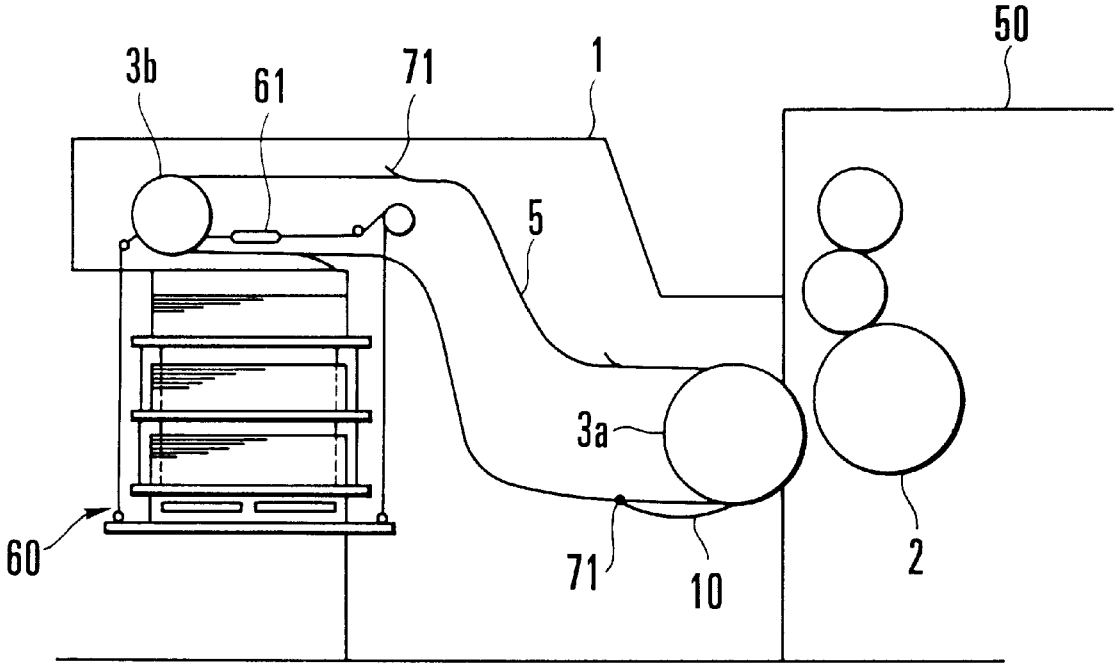
FIG. 3 is a schematic view showing the arrangement of a delivery unit for a sheet-fed offset printing press according to an embodiment of the present invention.
Figure 4:
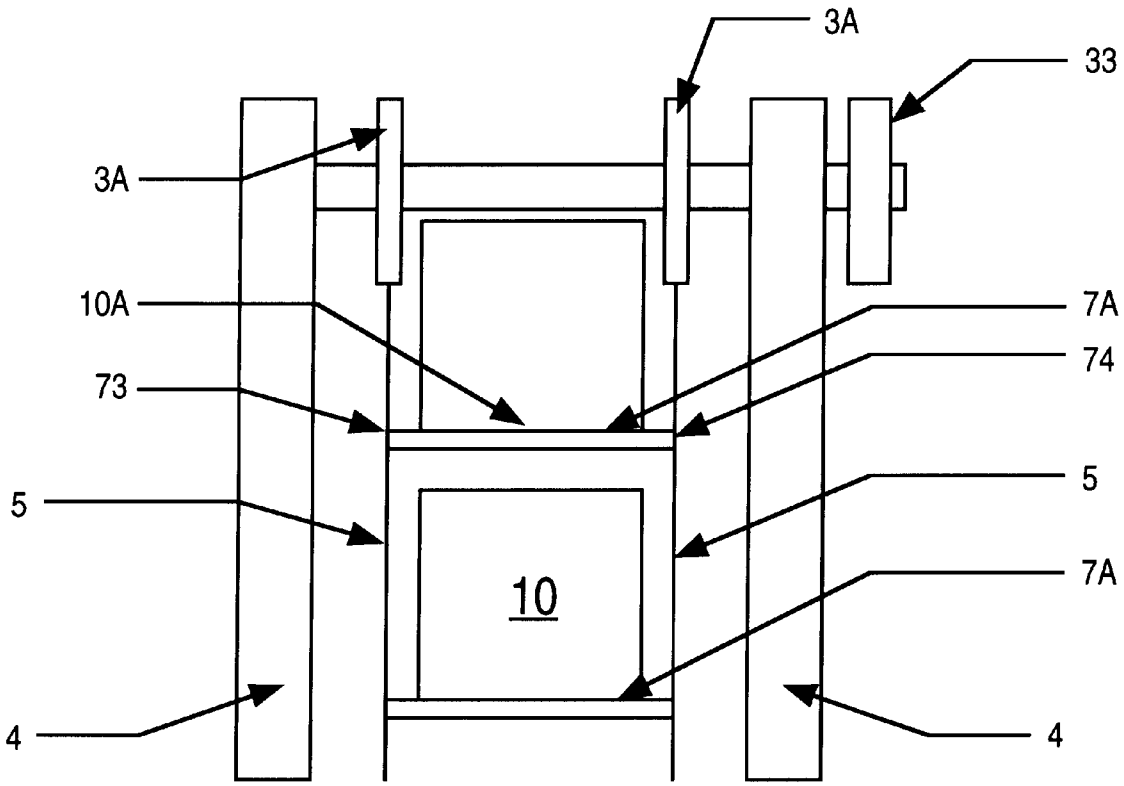
FIG. 4 is a top view of the gripper unit.

FIG. 3 shows the schematic arrangement of a delivery unit for a sheet-fed offset printing press according to an embodiment of the present invention. Referring to FIG. 3, reference numeral 1 denotes a sheet conveying unit 1 constituting the delivery unit. A final printing unit 50 having an impression cylinder 2 is arranged upstream in the sheet conveying direction of the sheet conveying unit 1. A pile board 60 on which a printed sheet 10 is stacked is arranged downstream in the sheet conveying direction of the sheet conveying unit 1. A pair of left and right sprockets 3*a* are arranged at an end upstream in the sheet conveying direction of the sheet conveying unit 1. A pair of left and right sprockets 3*b* are arranged at an end downstream in the sheet conveying direction of the sheet conveying unit 1. A pair of left and right delivery chains 5 as conveying means extend between the sprockets 3*a* and 3*b*. When the sprockets 3*a* rotate, the delivery chains 5 supporting grippers 71 at first end 73 and second end 74 of gripper unit 7*a*, as shown in FIG. 4, travel in the direction for delivering the sheet 10. In this way, the pair of delivery chains 5 are arranged at an interval that is larger than a width of the sheet 10, and two ends of the gripper units 73 and 74 are supported by the delivery chains 5 in the direction for delivering the sheet 10.

In the delivery unit with the above arrangement, the sheet 10 with its leading edge being gripped by the grippers 71 of the delivery chains 5 is delivered from the impression cylinder 2 of the printing unit 50 and conveyed onto the pile board 60 through the sheet conveying unit 1. When the grippers 71 are opened by a cam mechanism 61, the sheet 10 conveyed onto the pile board 60 is released and stacked on the pile board 60.

Figure 1:
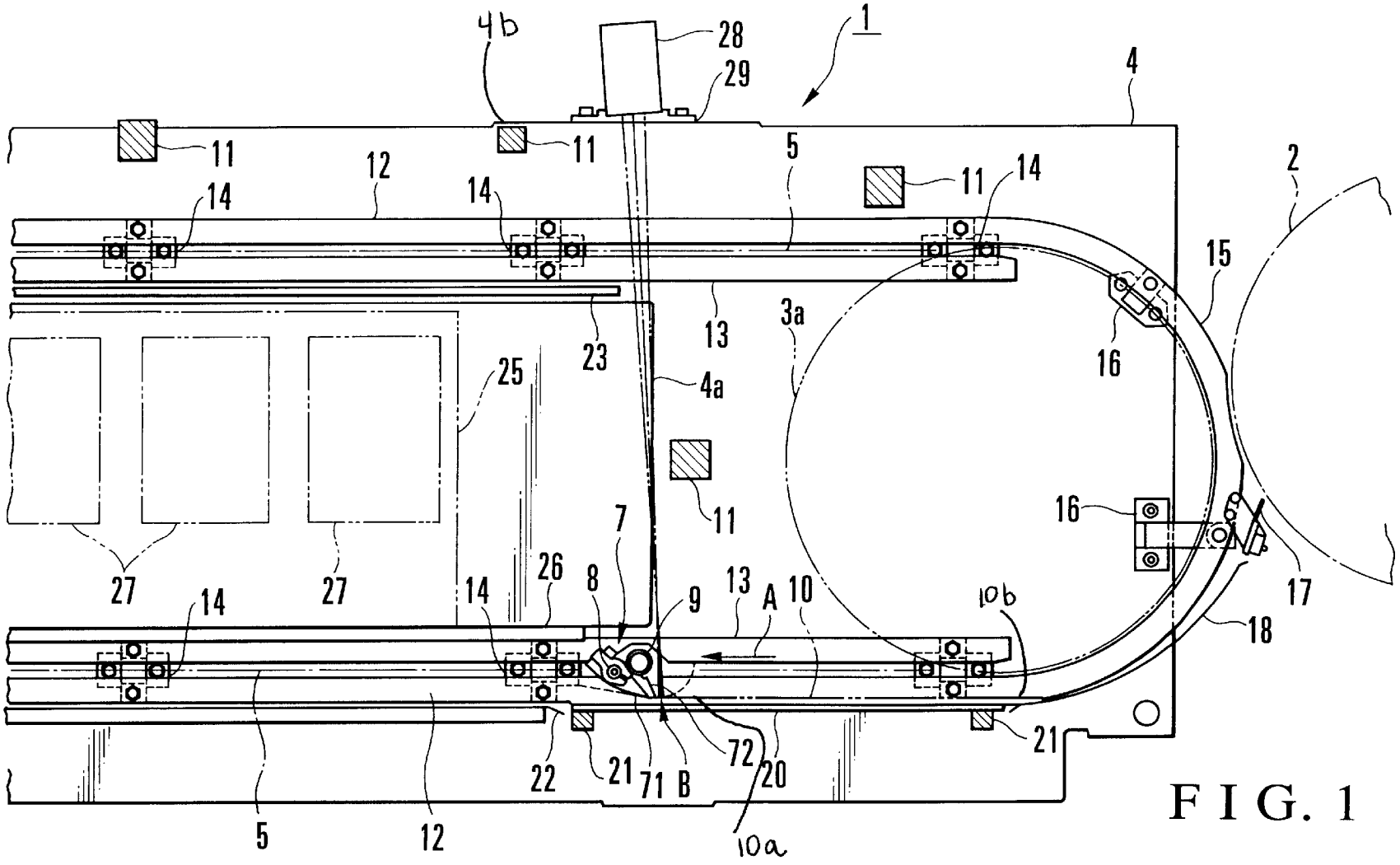
FIG. 1 is an enlarged side view showing the main portion of a sheet conveying unit shown in FIG. 3.

FIG. 1 shows the main portion of the sheet conveying unit 1 shown in FIG. 3. Referring to FIG. 1, the sheet conveying unit 1 has a pair of left and right delivery frames 4 each standing on the floor base through a column (not shown) and having a rectangular window 4*a*. The above-described sprockets 3*a* and 3*b* are rotatably supported by the pair of delivery frames 4 through bearings. Rotation of a motor is transmitted to the delivery chains 5 through driving gear 33 of FIG. 4 axially mounted on the shaft of the sprockets 3*a* so that the delivery chains 5 of FIG. 1 in the sheet conveying direction indicated by an arrow A.

A plurality of gripper bars 7 each having the above-described grippers 71 are arranged between the pair of delivery chains 5 at a predetermined interval in the conveying direction of the sheet 10. Each of the gripper bars 7 is constituted by a gripper shaft 8 and a gripper pad shaft 9 which are axially and parallelly held by the delivery chains 5, and a plurality of sets of the grippers 71 and gripper pads 72 which are arranged on the axes 8 and 9, respectively, to oppose each other. The sheet 10 delivered from the impression cylinder 2 of the printing unit 50 is gripped at lead end 10*a* by the grippers 71 and the gripper pads 72 and conveyed by the delivery chains 5 traveling in the direction indicated by the arrow A.

A plurality of tie-bars 11 span between the left and right delivery frames 4. Guide rails 12 and 13 are fixed on the upper and lower sides of the delivery frames 4 through stepped studs 14 such that the delivery chains 5 are guided between the rails 12 and 13. A pair of left and right semicircular guide rails 15 are fixed on the left and right delivery frames 4, respectively, through stepped studs 16 along the outer circumferences of the sprockets 3*a*.

Reference numeral 17 denotes a missing sheet regulation member fixed to the guide rails 15. The missing sheet regulation member 17 is arranged below the opposing position of the sprockets 3*a* and the impression cylinder 2 to prevent the sheet 10 that the grippers 71 of the gripper bar 7 has failed to grip from falling in the apparatus. A plurality of paper guides 18 each having an arcuate section are arranged between the delivery frames 4 at a predetermined interval. The paper guides 18 are separated from the outer circumferences of the sprockets 3*a* by a predetermined distance and regulate the instability of the trailing edge of the sheet 10 transferred from the grippers of the impression cylinder 2 to the grippers 71 of the gripper bar 7.

A paper guide plate 20 is horizontally arranged under the delivery chains 5 downstream in the sheet conveying direction from the paper guides 18 while being separated from the delivery chains 5 by a predetermined distance over the range where an inspection unit 28 (to be described later) inspects the printed surface of the sheet 10. The paper guide plate 20 is fixed, with bolts, to tie-bars 21 fixed between the delivery frames 4 with bolts such that the upper surface of the paper guide plate 20 becomes close to the gripping surface of the gripper pads 72 of the gripper bar 7.

A plurality of juxtaposed paper guides 22 are horizontally attached between the delivery frames 4 at a position close to the downstream side of the sheet conveying direction of the paper guide member 20. Reference numeral 23 denotes a grease receiving tray fixed to the lower portion of the upper guide rail 13 with bolts. Reference numeral 25 denotes a dryer unit having an UV irradiation unit and fixed, above the paper guides 22, to a rest 26 attached between the delivery frames 4. The dryer unit 25 can be extracted/inserted through the window 4*a* of the delivery frame 4.

The inspection unit 28 having a camera or the like is supported and fixed on upper end portions 46 of the delivery frames 4 through a bracket 29, i.e., arranged above the delivery chains 5. The inspection unit 28 optically measures the printing density value of the examination place such as the printed surface of the sheet 10 conveyed on the paper guide plate 20 and compares the measurement value with the density value of a standard image, thereby detecting a misfed sheet.

According to the above arrangement, since the inspection unit 28 is arranged above the delivery chains 5, the adjustment operation and the maintenance operation can be easily performed, as compared to the conventional arrangement in which the inspection unit is arranged between the upper and lower delivery chains 5. In addition, since the inspection unit 28 is separated from the dryer unit 25, the inspection unit 28 is not adversely affected by heat generated by the dryer unit 25. Therefore, highly accurate inspection is performed while preventing the erroneous operation of the inspection unit 28.

Figure 2:
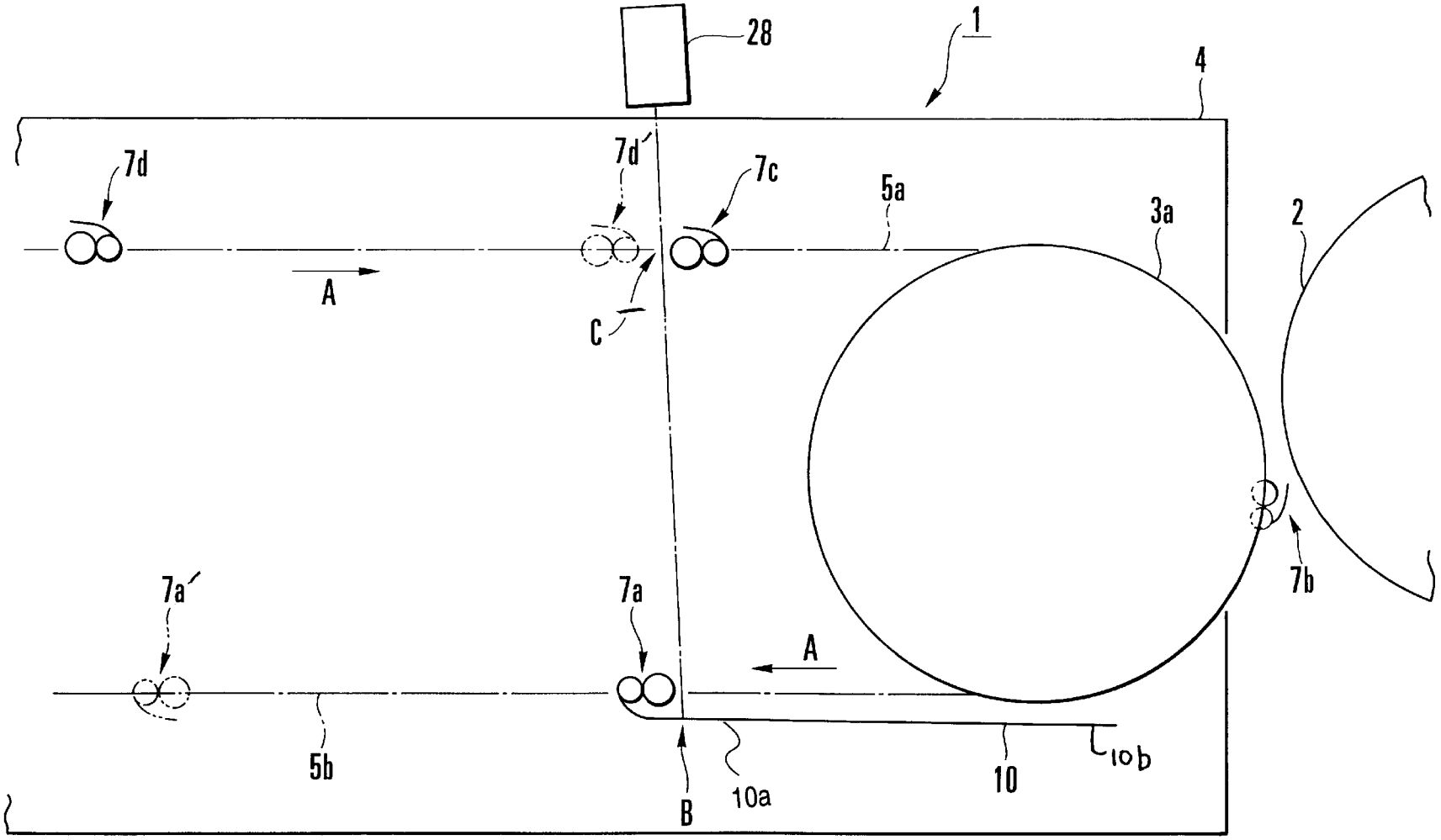
FIG. 2 is a view for explaining the relationship between the inspection operation of an inspection unit shown in FIG. 1 and movement of gripper bars.

As shown in FIG. 2, the inspection unit 28 inspects the printed surface of the sheet 10 which is being conveyed while being gripped by a gripper bar 7*a*at an inspection position B on lower delivery chains (conveying path) 5*b*. A point at which the inspection path such as the optical path connecting the inspection unit 28 and the inspection position B crosses upper delivery chains (return path) 5*a* constituting the conveying path is represented by C. The inspection unit 28 is positioned with respect to the sheet conveying direction such that, when the inspection unit 28 starts to inspect the gripped end portion of the sheet 10 at the point B such as lead end 10*a*, a gripper bar 7*c* supported by the upper delivery chains 5*a* passes the point C. Moreover, just before inspection of the trailing edge portion of the sheet 10 at the point B has finished (such as when gripper bar 9*a* moves to 7*a*') a subsequent gripper bar 7*d* moves to 7*d*' so as to be ready to pass the point C just after the inspection of the trailing edge portion. In this way, the inspection unit 28 of FIG. 2 inspects the sheet 10 conveyed to the inspection position B on the conveying path from a leading edge 10*a* to a trailing edge 10*b* within a period beginning after a preceding gripper unit 7*c* travels the intersection C on said return path until a next gripper 7*d* unit travels the intersection C.

In other words, the inspection unit 28 is positioned with respect to the sheet conveying direction on the basis of the interval of the gripper bars 7*a*, 7*b*, 7*c* and 7*d* such that, while the sheet 10 gripped by the gripper bar 7*a* is being optically inspected by the inspection unit 28 at the inspection position B, the gripper bars 7*c* and 7*d* supported by the upper delivery chains 5*a* do not shield the optical path of the inspection unit 28, i.e., do not impede the optical inspection operation of the inspection unit 28. More specifically, the inspection unit 28 is positioned such that the length of the delivery chain from the inspection position B to the intersection C via the sprocket 3*a* becomes an integer multiple of the interval of the gripper bars 7*a*, 7*b*, 7*c* and 7*d*.

A sheet printed state inspection operation of the inspection unit 28 having the above arrangement will be described next. The sheet 10 printed by the printing unit 50 of FIG. 3 is transferred from the grippers of the impression cylinder 2 to the grippers 71 and the gripper pads 72 of the gripper bar 7 of FIG. 1 and conveyed onto the paper guide plate 20 by the delivery chains 5 traveling in the direction indicated by the arrow A. Since the surface of the paper guide plate 20 is set close to the gripping surface of the gripper pads 72 of the gripper bar 7, the sheet 10 gripped by the grippers 71 and the gripper pads 72 is conveyed while horizontally sliding on the paper guide plate 20. This horizontal sliding maintains paper 10 at a fixed distance from inspection unit 28.

The printing density value of the printed surface of each sheet 10 which has conveyed while sliding on the paper guide plate 20 is optically measured by the inspection unit 28 at the inspection position B. When the measurement value differs from the density value of the standard image due to smear, setoff, misregistration, or the like, the inspection unit 28 outputs a misfed sheet detection signal. During this time, the inspection operation on the optical path of the inspection unit 28 is not shielded by a gripper bar 7 traveling with the upper delivery chains 5*a*. The detection signal output from the inspection unit 28 is sent to the gripping releasing unit of the delivery unit via, e.g., a delay circuit and used as a control signal for delivering the misfed sheet whose printed surface is being dried by the UV irradiation unit 27 of the dryer unit 25 to a route different from that to the pile board 60 of FIG. 3 on which normal papers are stacked. Alternatively, the detection signal is used as a control signal for inserting a tape under the misfed sheet stacked on the pile board 60 to discriminate the misfed sheet from normal sheets.

In the above embodiment, the delivery chains 5 are horizontally set as illustrated in FIG. 3. However, the present invention is not limited to this, and the delivery chains 5 may be set with an angle or in the vertical direction such as shown in FIG. 3.

In the above embodiment, the sheet 10 is conveyed from the final printing unit 50 to the pile board 60. However, the present invention is not limited to this and can also be applied to inspect the printed state of the sheet among a multiple of printing units.

As has been described above, according to the present invention, since the inspection unit 28 is arranged above the movement locus of the gripper bar 7, the adjustment and maintenance operations of the inspection unit are facilitated. In addition, proper inspection is performed while preventing the inspection operation from being impeded by the gripper bar supported by the upper chains. Furthermore, since the influence of heat generation by the dryer unit on the inspection unit is eliminated, the erroneous operation of the inspection unit can be prevented to perform highly accurate inspection.

What is claimed is:

1. A sheet inspection apparatus for a sheet-fed offset printing press, comprising:

endless conveying means for conveying a sheet delivered from a printing unit, said endless conveying means having a conveying path and a return path;

a plurality of gripper units, supported by said conveying means at a predetermined interval along a sheet conveying direction, for gripping one end of said sheet; and an inspection unit to optically inspect a printed state of said sheet conveyed on said conveying path, said return path being arranged between said inspection unit and said conveying path, said inspection unit being associated with said gripper units such that an optical inspection operation for said sheet at an inspection position on said conveying path is not impeded by said gripper units traveling on said return path.

2. An apparatus according to claim 1, wherein said inspection unit is positioned on the basis of an interval of said gripper units.

3. An apparatus according to claim 2, wherein said inspection unit is positioned such that a length of said endless conveying means from a position at which a line connecting said inspection unit and the inspection position on said conveying path crosses said return path to the inspection position along the conveying direction by said endless conveying means, becomes an integer multiple of the interval of said gripper units.

4. An apparatus according to claim 3, wherein said inspection unit inspects said sheet conveyed to the inspection position on said conveying path from a leading edge to a trailing edge within a period after a preceding gripper unit travels the intersection on said return path until a next gripper unit travels the intersection.

5. An apparatus according to claim 1, wherein said conveying path is horizontally arranged, said return path is arranged above said conveying path to be parallel to said conveying path, and said inspection unit is arranged above said return path.

6. An apparatus according to claim 5, further comprising a pair of frames opposing each other through said conveying means and supporting said conveying means therebetween along the sheet conveying direction, and wherein said inspection unit is supported at an upper end portion of at least one of said frames positioned above said return path.

7. An apparatus according to claim 1, wherein said conveying means comprises a pair of delivery chains arranged at an interval larger than a width of said sheet, and two ends of said gripper units are supported by said delivery chains.

8. An apparatus according to claim 1, further comprising dryer means, arranged downstream from the inspection position on said conveying path along the sheet conveying direction, for drying said sheet between said conveying path and said return path, and wherein said conveying means is arranged between said printing unit and a pile board to convey said sheet delivered from said printing unit, inspected by said inspection unit, and dried by said dryer means onto said pile board.

9. A sheet inspection apparatus for a sheet-fed offset printing press, the sheet inspection apparatus comprising:

a printing unit;

means for conveying a sheet from the printing unit, the means for conveying having a return path and a conveying path, the sheet having a lead end and a printed state;

an inspection unit adapted to examine the printed state of a sheet wherein the return path is disposed between the inspection unit and the conveying path; and a plurality of gripper units wherein each gripper unit is adapted to grasp the lead end of a sheet and wherein each gripper unit is coupled to the means for conveying at a location that permits unimpeded examination of each sheet located on the conveying path by the inspection unit.

10. The sheet inspection apparatus of claim 9 wherein the return path is disposed vertically between the inspection unit and the conveying path, wherein a distance between the location of a first gripper unit and the location of a second gripper unit defines an interval, and wherein the location of the inspection unit is a function of the interval.

11. The sheet inspection apparatus of claim 10 wherein the sheet has a length and wherein the interval is greater than the length of the sheet.

* * * * *

UNITED STATES PATENT AND TRADEMARK OFFICE

CERTIFICATE OF CORRECTION

PATENT NO. : 5,974,683
DATED : November 2, 1999
INVENTOR(S) : Shibata

It is certified that error appears in the above-identified patent and that said Letters Patent is hereby corrected as shown below:

Title page,
Item [56], References Cited, U.S. PATENT DOCUMENTS, insert
-- 5,797,321 8/1998 Shibata 101/246 --.
Item [30], Foreign Application Priority Data, replace "8-196083" with
-- 1960831996 --.

Signed and Sealed this

Sixteenth Day of May, 2006

JON W. DUDAS
*Director of the United States Patent and Trademark Office*